US008661716B2

(12) United States Patent
Stead

(10) Patent No.: US 8,661,716 B2
(45) Date of Patent: Mar. 4, 2014

(54) PROTECTIVE FOOTWEAR

(76) Inventor: Michael Philip Stead, Leicestershire (GB)

( * ) Notice: Subject to any disclaimer, the term of this patent is extended or adjusted under 35 U.S.C. 154(b) by 556 days.

(21) Appl. No.: 12/597,763

(22) PCT Filed: Apr. 25, 2008

(86) PCT No.: PCT/GB2008/001472

§ 371 (c)(1),
(2), (4) Date: Oct. 27, 2009

(87) PCT Pub. No.: WO2008/132466

PCT Pub. Date: Nov. 6, 2008

(65) Prior Publication Data

US 2010/0115795 A1 May 13, 2010

(30) Foreign Application Priority Data

Apr. 27, 2007 (GB) ..... 0708152.4

(51) Int. Cl.
*A43B 1/10* (2006.01)
*A43B 1/02* (2006.01)

(52) U.S. Cl.
USPC ..... 36/102; 36/7.1 R; 36/43

(58) Field of Classification Search
USPC ..... 36/102, 103, 7.1 R–7.8, 43, 44, 71
See application file for complete search history.

(56) References Cited

U.S. PATENT DOCUMENTS

| | | | | |
|---|---|---|---|---|
| 4,246,707 | A * | 1/1981 | Pedersen | 36/100 |
| 4,967,491 | A * | 11/1990 | Plotkin | 36/7.1 R |
| 5,570,523 | A | 11/1996 | Lin | |
| 5,659,979 | A | 8/1997 | Sileo | |
| 5,799,415 | A | 9/1998 | Kenji et al. | |
| 6,427,363 | B1 | 8/2002 | Hunter | |
| 6,715,219 | B2 * | 4/2004 | Bock | 36/132 |
| 6,836,976 | B2 * | 1/2005 | Haugland | 36/10 |
| 6,904,705 | B2 * | 6/2005 | Polegato Moretti | 36/11 |
| 7,140,129 | B2 * | 11/2006 | Newson et al. | 36/100 |
| 7,162,813 | B2 * | 1/2007 | Haft | 36/9 R |
| 7,168,190 | B1 | 1/2007 | Gillespie | |
| 7,694,435 | B1 * | 4/2010 | Kiser et al. | 36/11.5 |
| 7,735,244 | B1 * | 6/2010 | Ameche | 36/102 |
| 2004/0181968 | A1 | 9/2004 | Haugland | |
| 2005/0229428 | A1 * | 10/2005 | Holcomb | 36/7.1 R |

FOREIGN PATENT DOCUMENTS

| | | | |
|---|---|---|---|
| FR | 2 813 766 | A1 | 3/2002 |
| FR | 2 842 400 | A1 | 1/2004 |
| GB | 511821 | | 8/1939 |
| GB | 2 311 204 | A | 9/1997 |
| GB | 2 398 722 | A | 9/2004 |
| JP | 5-228001 | A | 12/1991 |
| WO | 2004/103105 | A1 | 12/2004 |

OTHER PUBLICATIONS

Int'l Search Report dated Jul. 16, 2008.
GB Search Report dated Jul. 30, 2007.

* cited by examiner

*Primary Examiner* — Jila M Mohandesi

(57) ABSTRACT

An article of footwear which has a body consisting of a polymer material, and which is shaped to closely surround a wearer's foot during use. The article of footwear has a planar insert locatable within the body portion to improve the puncture resistance of the footwear. The body may be formed as a single homogenous piece of moulded material and is deformable between a storage condition and an in use condition.

20 Claims, 4 Drawing Sheets

PROTECTIVE FOOTWEAR

CROSS REFERENCE TO RELATED APPLICATION

The present application is the U.S. national stage application of International Application PCT/GB2008/001472, filed Apr. 25, 2008, which international application was published on Nov. 6, 2008 as International Publication WO 2008/132466. The International Application claims priority to Great Britain Patent Application 0708152.4, filed Apr. 27, 2007.

The present invention relates to footwear and, more particularly, although not exclusively to disposable footwear.

Conventional footwear generally comprises a substantially rigid sole and a leather or textile upper. Such footwear is relatively bulky and awkward to carry by hand or in a small enclosure such as a purse or pocket.

It is a well known problem that relatively stiff or ill-fitting footwear can cause discomfort to a wearer and can result in blistering of the skin. In particular, high-heeled footwear often causes pain to a wearer during extended periods of use. This problem has been well documented and has resulted in a number of products becoming available to reduce the discomfort experienced by a wearer, such as gel-like padding members for insertion between a user's foot and the article of footwear.

Despite such products, extended periods of discomfort caused by footwear often results in a user taking off their shoes. It is not uncommon to see women walking barefoot towards the end of an evening whilst holding a pair of shoes in their hands. Studies have shown that walking barefoot in this manner carries a significant risk of infection or injury. This risk is greatly increased when walking even a short distance outside without shoes, at least in part, due to the likelihood of a person's foot being abraded or even punctured by debris or the like.

It is generally awkward and inconvenient to have to carry an alternative pair of shoes on the premise that the shoes being worn may potentially cause discomfort. Therefore people are faced with either the pain of continuing to wear an uncomfortable pair of shoes or else the risk of discomfort, injury or infection associated with walking barefoot.

It is an object of the present invention to provide footwear which is convenient to carry and which can sufficiently protect a wearer's feet.

According to the present invention there is provided an article of footwear comprising a body portion comprising a polymer based material, the body portion being shaped to resiliently surround a substantial portion of a wearer's foot during use, and a planar insert member locatable within the body portion so as to improve the puncture resistance of the footwear.

The body portion may consist substantially of a moulded material.

The present invention is particularly advantageous since the insert member provides sufficient puncture resistance to allow a low-cost moulded article of footwear to be worn either inside or outside a building without significant risk of injury or infection. Thus the relatively low puncture resistance of a thin-walled moulded article of footwear may be compensated for by the properties of the insert member. The footwear may protect a wearer's feet from abrasion, cuts, infection as well as ambient temperature or moisture.

In addition, the moulded nature of the body allows the body portion to be folded or otherwise manipulated into a small storage space such that it is convenient to carry by hand, in a purse, clutch bag or the like and/or easy to dispense at the point of requirement. Thus the article of footwear may be extremely lightweight, ultra compact and can be manufactured at very low cost. In addition, the article of footwear is intended for single or limited use such that it may be durable for a few miles distance of wearing only. The body portion may be resiliently and/or reversibly deformable.

According to one embodiment, the body portion comprises a polymer based material. The body portion may be elastic in nature and may be elastomeric. Preferably the body portion comprises a non-woven polymer material which is formed as a single piece which is substantially homogenous. A single piece polymer may comprise a self-reinforcing polymer, which comprises an initially woven polymer material which is used to create a substantially homogenous moulded product by application of heat and pressure.

In one embodiment, the body portion comprises latex. The body portion may conform to the shape of a wearer's foot and so a single or limited number of body portions can be provided to cater for wearers' varying foot sizes.

Typically the article of footwear covers substantially the whole of a user's foot. The body typically takes the form of a flexible hollow carcass or shell into which the user's foot is insertable.

The body portion is preferably moulded to form a single piece body portion, the thickness of which is preferably between 0.1 and 5 mm. Yet more preferably, the body portion has a wall thickness of between 0.2 and 0.7 mm. In one embodiment, the body portion comprises one or more tread portions having an increased thickness. The tread portions are typically in the region of the area of contact between a user's foot and the ground so as to provide additional puncture resistance over the region of the body portion which carries the wearer's weight. A preferred range for the thickness of the tread portion is between 0.7 and 3 mm.

The wall thickness of the body portion, results in the volume of the body portion according to the present invention being substantially lower than that of a conventional shoe or sandal. According to one embodiment a pair of the articles of footwear according to the present invention can be accommodated within a volume of 225 $cm^3$ or less.

According to one preferred embodiment the insert member comprises one or more fold lines such that the insert member can be folded between a storage format and a usage format. The storage format typically conforms to a substantially cuboid profile such that the article can be contained within the insert member in the storage format. The storage format may conform to a standard sized carton. Thus the article and insert member can be located in standard vending apparatus.

The insert member may form a container for the article of footwear in the storage format or else may be insertable into a container such as standard carton.

In an alternative embodiment, the insert member is located with the body portion as part of the moulding process. The insert member may be adjoined to the body portion during moulding. In this embodiment, the insert member is typically located against an outer surface of the body portion when formed and the body portion is subsequently inverted for use. The body portion may be rolled or folded along with the insert member for storage in an enclosure.

The insert member in may comprise one or more cut or tear lines. In one embodiment, the cut or tear lines define a perimeter of the insert member in the usage format. The cut or tear lines may comprise lines of weakness and may define material to be removed when converting the insert member from the storage format to the usage format. Additionally, or else alternatively, the cut or tear line may define material to be removed for customization of the size or shape of the insert member to suit the foot size of the wearer.

The insert member may comprise cardboard or else a polymer or other suitably resistant material. Additionally or alternatively, the insert member may comprises one or more textile materials having tear-resistant, slash-resistant or stab-resistant properties. In one embodiment, the insert member may comprise a plurality of adjacent layers of different material.

According to a second aspect of the present invention, there is provided an article of footwear which is convertible between a storage and a usage condition, at least one the dimension of the article of footwear in the storage format being smaller than in the usage format, wherein the article of footwear comprises a moulded body portion and a planar insert member, the body portion and insert member being resiliently deformable such that the storage format conforms to a smaller profile than the usage format and wherein the insert member is locatable within the body portion in the usage format so as to improve the puncture resistance of the footwear.

The storage condition forms a profile which is convenient for transport or vending. Preferably but not exclusively the storage format is cuboid in profile although the footwear may alternatively be presented in any volumetric format such as for example a tube. In the embodiment of a cuboid, the insert member is preferably foldable about one or more fold lines. For a carton or else a container having a tubular or cylindrical format, the body portion and insert member may be folded and/or rolled up into the storage condition.

Typically the body portion is contained within the insert member in the storage format. The storage format may take the form of a retail unit such as a container, in which the body portion is stored. In the storage format, the article of footwear occupies significantly less space than the volume of a foot, which can be accommodated during use. Thus the footwear is simple to carry by hand or else in a pocket, purse or the like.

Preferred embodiments of the present invention are described in further detail below with reference to the accompanying drawings, of which:

Figure 1:
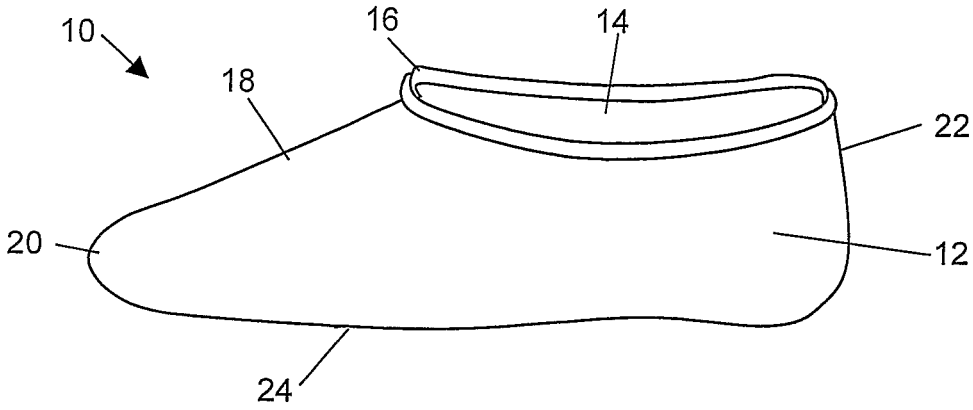
FIG. 1 shows a side view of an article of footwear according to the present invention.
Figure 3A:
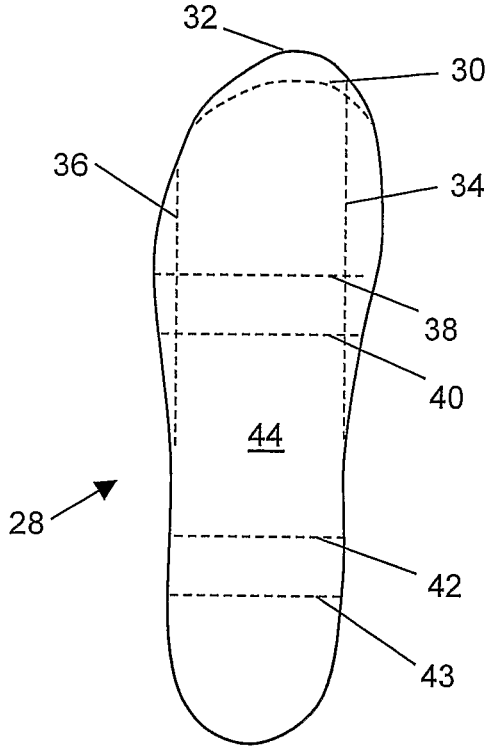
Figure 3B:
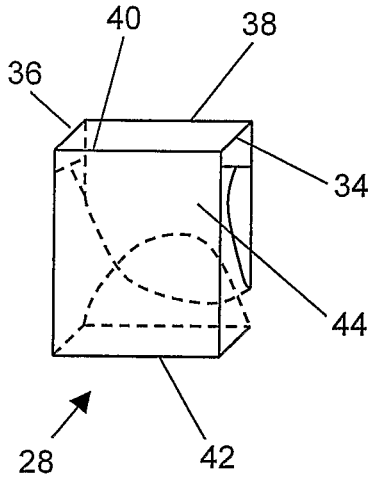
Figure 4:
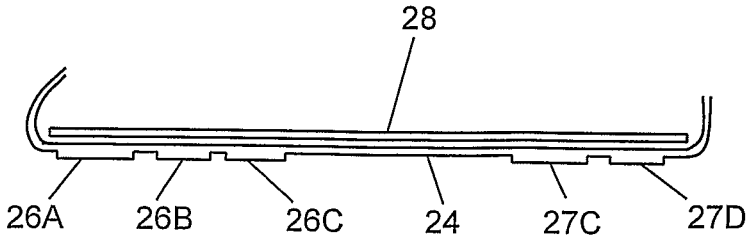
Figure 5:
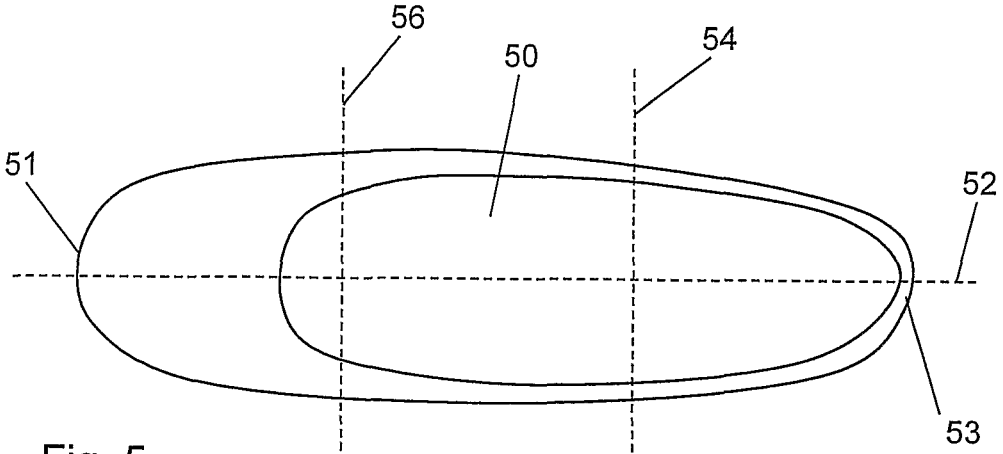
Figure 6:
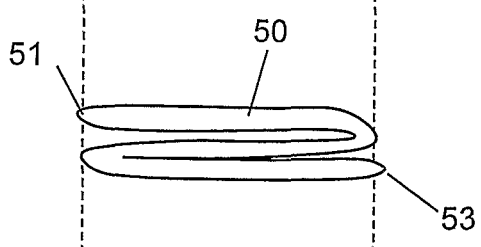
Figure 7:
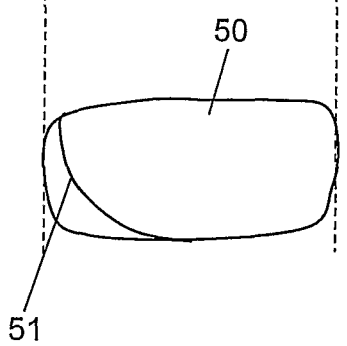
Figure 8:
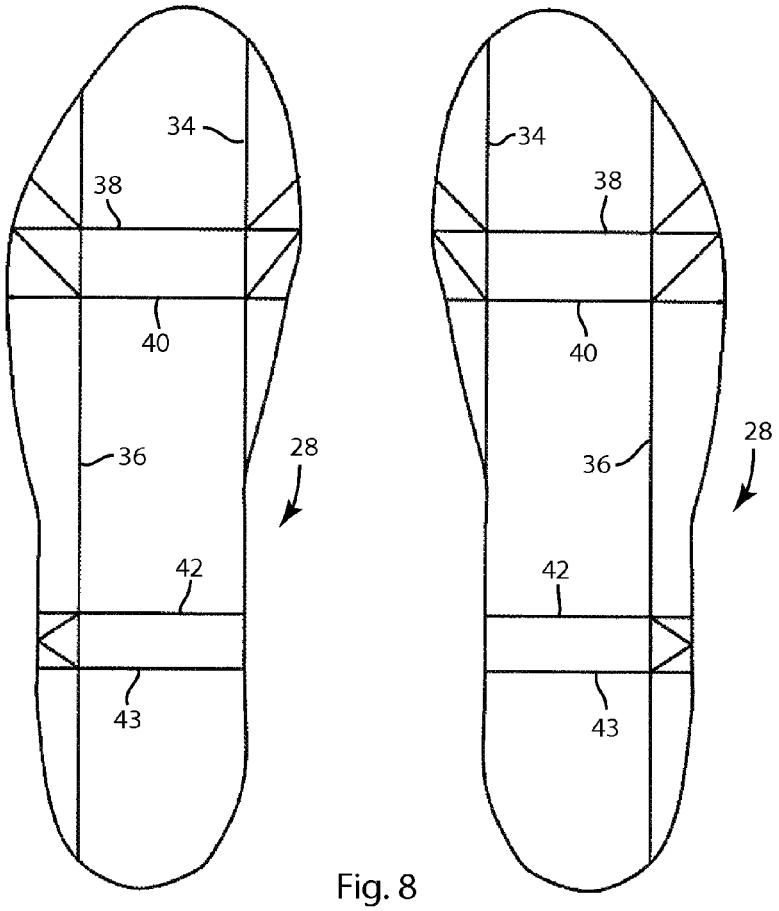
Figure 9:
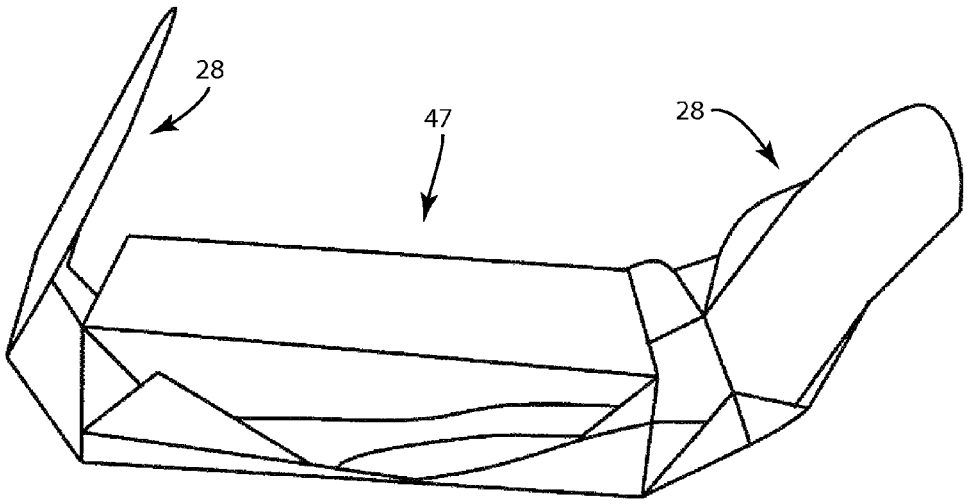

FIGS. 3*a* and 3*b* show views of an insert member according to the present invention in respective usage and storage formats;

FIG. 4 shows a cross section through the length of the footwear of FIG. 1 when in use;

FIG. 5 shows a plan view of an article of footwear according to a further embodiment;

FIG. 6 shows a side view of the article of FIG. 5 in a folded condition;

FIG. 7 shows a plan view of the article of FIG. 5 in a folded condition;

FIG. 8 shows a top view of a pair of insert members in the in use condition; and FIG. 9 shows the pair of insert members each in the storage condition and combined to form and enclosure.

The present invention allows an article of footwear to be presented to a consumer in a format in which the footwear can be conveniently carried and stored by a user until usage of the footwear is required. The footwear may be disposable in that it is only intended for a single or a limited number of uses. Thus the footwear may be lightweight, avoiding the need for complicated manufacturing and assembly processes attributed with conventional footwear such that the cost of the article is reduced.

The article of footwear 10 is shown in FIG. 1 and comprises a single-piece body portion 12, shaped to conform substantially to a wearer's foot. The body portion has an opening 14, through which a user can insert or remove their foot from the footwear.

The opening 14 has a rim 16 of increased thickness to protect the footwear from splitting or tearing at the point at which pressure is applied by a user to don or remove the footwear. Alternatively, the rim 16 may be of similar or reduced thickness compared to a remainder of the body 12 and may be crimped, cut or otherwise machined to give a desired finish. In this embodiment, the rim 16 passes around the entire perimeter of the opening 14.

It will be appreciated that the opening 14 is of dimensions sufficient to pass around the upper portion of a wearer's foot during use in a manner similar to that of a shoe or slipper. The body portion is resiliently elastic and therefore stretches such that the footwear 10 lightly grips the users foot over a substantial portion of the inner surface of the body 12. This is in contrast to other forms of footwear such as socks or the like which grip a wearer's ankle. Thus a distinction can be drawn between articles of footwear which grip at the ankle—for which conformity to a user's foot is less crucial—and shoes or slipper-type footwear which rely on conformity with the shape of the foot to remain correctly seated for use.

As can be seen in FIG. 1, the body 12 generally comprises an upper portion 18 located towards the front or toe end 20 of the footwear, with the opening 14 being generally positioned towards the rear or heel end 22. In such an arrangement, a user's foot is typically held within the article of footwear 10 by conformity of the footwear about a user's foot and abutment of the upper side of a user's foot against the inside surface of the frontal upper portion 18.

In addition, a slight tension in the footwear may assist the adherence of the footwear to a wearer's foot, such as a tension exerted to a wearer's heel at heel end 22 of the footwear. This is in contrast to footwear which requires a sufficiently elastic rim to grip a wearer's ankle in order to remain in place. The opening 14 of the article of FIG. 1 may be larger than any such conventional footwear and may thus allow an improved aesthetic design. The footwear of FIG. 1 may be considered to be similar to a 'slip-on' footwear design, rather than an article of footwear which requires additional tightening about a wearer's foot in order to remain in place. Accordingly, the present invention may not require a gusset to allow a front opening for donning the footwear as is required by conventional shoes.

The entire body portion 12 is formed as a unitary member by way of a moulding process. It will be apparent to a person skilled in the art that a number of moulding processes would be suitable for generation of a thin walled component of this type, such as, for example, dip moulding, injection moulding, rotational moulding in which the body is formed against the internal wall of a hollow rotating mould. Thus the body portion can be formed in a single manufacturing step without the need for stitching or other manufacturing steps, which are required to produce composite shoes.

Dip moulding has been found to provide a suitable manufacturing process in which a suitably-shaped tool is dipped into a bath of liquid, which liquid cools to form an elastomeric skin of material upon removal from the bath. One or more repetitions of the dipping process may be used to achieve a skin of required thickness. The skin is then removed from the tool and may be inverted to form the body 12.

The body 12 may be described as being homogenous in contrast to conventional shoes, for which a sole and upper of different materials are used. A homogenous article of footwear may be considered to be formed of a material which is substantially uniform throughout the body portion. The material properties of the upper portion of the body may thus be the same as the material of the sole of the body. The sole, upper and/or cuff of the body 12 are formed as a single piece, preferably using an elastomeric material. Such a material is inherently waterproof.

The body portion comprises a natural or synthetic polymer based material such as a silicone, latex, a vinyl such as PVC or the like. The term 'polymer-based' material is intended to cover any materials having a non-trivial polymer or monomer-based content. The skilled person will appreciate that numerous materials or combinations of materials may be suitable dependent on the required price of the footwear and the level of protection required. In one embodiment, biodegradable materials may be used in keeping with the disposable nature of the footwear, such as, for example, PVAXX®, which degrades from moisture in the air.

The body portion may be of a single shape which is suitable for either of a user's left or right foot or else may be shaped to suit a particular foot as required.

The body portion may also have an inner lining material arranged to be adjacent a wearer's foot during use. Such an inner lining material may be provided for example by way of flocking. Cotton flocking has been found to provide a suitable lining material which provides a dry and comfortable feeling against a wearer's skin. Flocking also helps to absorb small amounts of perspiration from a wearer's foot during use.

Figure 2:
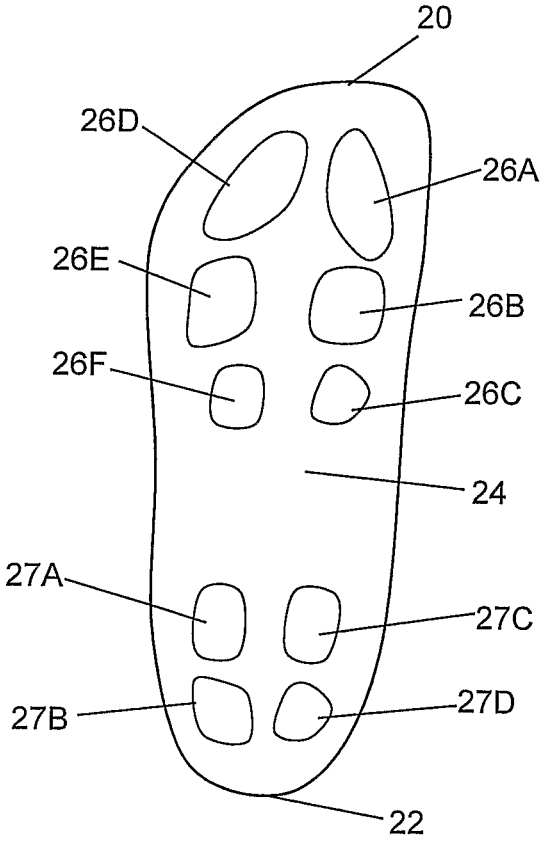
FIG. 2 shows a below view of an article of footwear according to the present invention.

Turning now to FIG. 2, the sole 24 of the body 12 is shown. The sole 24 has a series of raised formations 26 and 27 having greater thickness than the remainder of the sole 24. The raised formations 26*a*-26*f* are located toward front end 20 of the body 12 such that they lie beneath the toes and ball of the foot (Phalanges and Metatarsals) towards the front of a wearer's foot. The formations 27*a*-27*d* lie towards the rear end 22 beneath a wearer's heel (Calcaneus and Talus). Thus additional thickness of material is provided in the vicinity of the weight-bearing portions of a wearer's foot.

Such raised portions can simply be formed during moulding, for example by the provision of correspondingly shaped recesses within the mould. It will be appreciated that either a dip moulding, a single-shot or else a two-shot injection moulding, including overmoulding and double dip moulding process could be used, although other conventional moulding techniques are available.

In the embodiment shown, the thickness of the raised formations is roughly 1 mm, whilst the remainder of the body has a thickness of roughly 0.4-0.9 mm.

Turning now to FIG. 3, an embodiment of the insert member in the form of insole 28 is shown. The insole is made of a sheet plastic material or else plain card although numerous other materials can be used to provide the required puncture and/or stab resistance for a given thickness. In order to maintain the small volume of the package in the storage format, the thickness of the insole is preferable less than 2 mm and, more preferably, less than 1 mm. This allows use of polymers such as, for example, polyurethane, polyethylene, HDPE, PVC, nylon or the like which provide the requisite stab resistance for use in conjunction with the present invention.

A textile material may also be used in conjunction with the base material of the insole to provide puncture resistance. In this regard, fibres such as silk, Dyneema® or the like may be used and a layer of textiles material may provide additional comfort to the wearer. Such additional materials may or may not be used dependent on the price and level of protection required.

The use of a protective insole in this manner is counter-intuitive in light of conventional footwear, in which the outer sole of the shoe typically provides puncture resistance. In contrast, the sole of the body of the present invention provides only limited protection, whereas the insert member or insole 28 has been tailored to provide sufficient strength, resilience and puncture resistance to protect the wearer's foot. Accordingly the strength, resilience and/or puncture resistance of the insole of the present invention is typically greater than that of the body 12. Furthermore, the cushioning effect of the elastomeric sole of the body portion is greater than that of the insole 28.

The insole 28 takes the general shape of a user's sole. A cut or tear line 30 is provided towards either or both of the front and rear ends 32 of the insole 28 such that a frontal, rear or both portions of the insole can be removed to cater for smaller foot sizes. In this manner it has been found that a single standard insole can be provided which is adjustable by the wearer to cover the majority of adult shoe sizes. The elasticity of the body portion 12 also allows a broad range of size fittings to be catered for using a single design. Thus it is envisaged that the body portion will need to be produced in only a small (for example UK sizes 3-5) and a large size (for example UK sizes 6-8) fitting in order to cover the majority of adult shoe sizes.

The provision of only two sizes to cover an entire range of adult shoe sizes is particularly advantageous, since it removes the necessity to manufacture and supply at the point of sale a number of sizes which are required less frequently and which therefore represent dead stock.

The size ranges indicated are not mutually exclusive, as it will be apparent to a person skilled in the art of design, material development and or manufacturing that a number of variants around the general theme of elasticity together with material properties such as elongation and their subsequent development may result in larger size variations being accommodated by a single design of article. Furthermore, a one size fits all product based on this general theme may be achievable.

Preferably the line 30 comprises a line of weakness such as a line of scores or perforations which can be manually severed by a user without the need for scissors or the like.

The insole 28 is also provided with a number of fold lines 32-42. Fold lines 34 and 36 run substantially longitudinally along at least a portion of the insole 28 and fold lines 38-43 are oriented substantially perpendicular thereto, extending laterally across the insole 28. The sections of fold lines 38 and 40 which lie between the fold lines 34 and 36 and the respective outer edge of the insole are cut lines. The remainder of the fold lines may be marked on the insole 28 to indicate the folds to be made or else may be lines of weakness.

The fold lines 40 and 42 define a generally rectangular section 44 which defines the face of a cuboid, when the insole is converted to the storage format as shown in FIG. 3*b*. The insole is converted to the storage format by folding substantially 90° about each of the fold lines.

A pair of body members 12 shown in FIG. 1 can be inserted into the space substantially enclosed by the folded insole such that the footwear can easily be stored and carried. The insole is insertable into a carton/container or else the insole itself may form a carton/container in the storage format.

It will be appreciated that the folded insole does not form a complete enclosure in the embodiment shown. However a first insole folded in the same manner but in an opposite orientation to a second insole allows a complete enclosure to be formed in the shape of a right-angled carton by the combined insoles, one inside the other.

FIG. 8 illustrates a pair of insoles 28 each in the in use condition prior to being folded along the plurality of fold lines to define the storage position shown in FIG. 3*b*. FIG. 9 illustrates an embodiment in which the pair of insoles are combined with each other to define a complete enclosure 47. When the pair of insoles 28 are combined to create the complete enclosure 47, the complete enclosure takes the shape of a right-angled carton that can receive a pair of body portions.

In an alternative embodiment, which is in some ways preferred, the insole may be provided in the form of a conventional container blank, which has a line of weakness defining the outer perimeter of the insole such that the insole can be torn or cut out from the blank.

In a further alternative embodiment, wherein the storage format takes the form of a tube, the insole may be provided in the form of a conventional container blank, which has a line of weakness defining the outer perimeter of the insole such that the insole can be torn or cut out from the blank. Alternatively the insole may be shaped to correspond to the profile of the body portion and may be rolled up with the body portion.

Whilst a single insole and body portion are shown in FIGS. 1-4 it will be appreciated that a pair of insoles and body portions are typically, but not exclusively provided in a single retail unit for use by a user. Thus two body portions can be inserted into the spaced formed by the folded insole. The positions of the fold lines on one insole may be adjusted slightly to allow one insole to be folded around another.

The footwear according to the present invention will be vended in the form of a packaged retail unit comprising of one or a pair of insoles in the storage condition, with one or a pair of body members 12 contained therein. Upon opening the retail unit, a user can remove the body members, manipulate the insert members into the planar usage format and insert the insoles into the respective bodies to form slipper-like protective footwear.

The location of the insole 28 in the lower part of the slipper 12 is shown in FIG. 4. It can be seen that the insole 28 lies substantially flat adjacent the tread of the footwear. Each article of footwear thus comprises two component parts and can be erected in a matter of seconds.

After use the user can dispose of the footwear or else remove the insoles for storage and subsequent reuse. Since the articles are provided to the user in the storage condition, it may not be necessary to indicate the fold lines 34 to 43 on the insole. Printed indicia and/or instructions for use will typically be provided on the packaging or else on the insoles 28.

FIGS. 5 to 7 show one example of the folding operations which may be carried out such that a pair of articles according to the present invention may be accommodated in small volume which is convenient for carrying and/or vending the articles of footwear at a desired location.

FIG. 5 shows a plan view of a body 50 according to the present invention. It will be appreciated that the body 12 and the body 50 are of slightly different shape to accommodate different styles of footwear according to the present invention. However the bodies 12 and 50 are otherwise interchangeable and any description of one body portion may equally be applied to the other.

In FIG. 5, three fold lines 52, 54 and 56 are shown. The fold line 52 runs substantially longitudinally, typically along a centreline of the body from the toe portion 51 to the heel 53. The fold lines 54 and 56 run substantially laterally across the width of the body 50. Thus the body may be folded one or more times length wise and also one or more times width wise.

If the folding pattern of FIG. 5 is carried out by folding the body first in half along its length and subsequently twice across its width about fold lines 54 and 56, the side profile of the folded article may be substantially as shown in FIG. 6. Thus it will be appreciated that the folded body may be less than half its in use length and typically approximately a third of its in use length. The spaced folds about lateral fold lines 54 and 56 form a triple layer or 'S' shaped folded article.

In addition, it can be seen the folded article is approximately half of its original width as shown in the plan view of the folded article in FIG. 7. Multiply folding in this manner forms a body of reduced plan dimensions by a factor of approximately six. That is to say that the plan area of the body may be folded three times in order to achieve a six layer folded body having approximately one sixth the plan area of the in use body 50.

Whilst this represents one embodiment of the present invention, other forms or rolling and/or folding of the body are possible in order to achieve a reduced plan area for storage of preferably half or less than the in use plan area of the body. More preferably, the plan area of the body for storage is a third or less than the plan area of the body in use. Yet more preferably, the plan area of the body in the storage condition is a quarter or less of the plan area in use.

The wall thickness of the body is preferably less than 2 mm over a substantial portion of the body in order to allow folding of the body as described above. The wall thickness is preferably less than 2 mm over the majority of the body and may be less than 2 mm over substantially the whole body with the possible exception of the tread portions 26 and 27. The wall thickness of the body may be less than 1.5 mm and is typically in the vicinity of 1 mm thickness or less over the whole or at least a majority of the body.

When folded, the body in the storage condition typically has a depth or thickness of less than 2 cm and preferably less than 1.5 cm. In the example of FIGS. 5 to 7, the thickness of the body 50 in the folded condition is less than 1 cm when pressed into a suitable container and may be roughly between 7 and 8 mm thick.

In addition, whilst the above description refers to folding or rolling of the sole, it will be appreciated that the present invention allows other forms of deformation of the body, such as by way of scrunching, wrinkling, creasing or otherwise multiply folding the body. Such modes of deformation, and the resultant reduction in area of the body are not achievable using conventional footwear.

One particular advantage of the present invention is that a pair of body portions and a pair of insert members can be accommodated within the approximate volume of a conventional carton of twenty cigarettes. Thus the present invention allows for the vending of footwear from a conventional cigarette vending machine without substantial alteration of the mechanics of the vending machine.

In addition it has been found that a plastic bag including a shoulder strap can also be accommodated along with the articles of footwear within the volume of a conventional carton of cigarettes. Thus, when a wearer removes their shoes in order to don the articles of footwear according to the present invention, the wearer also has available a bag for carrying their original shoes. Furthermore the relatively low material and production costs of the present invention allow the articles of footwear to be priced and used as single or limited use disposable footwear. To this end, the materials used for the body and insert members may be biodegradable.

The invention claimed is:

1. An article of footwear comprising:

a body portion comprising a polymer based material, said body portion including a sole and an upper portion shaped to resiliently surround a substantial portion of a wearer's foot during use; and a substantially planar insert member positioned within said body portion in an in use condition so as to improve the puncture resistance of said article of footwear, wherein said insert member has one or more fold lines, wherein when the insert member is removed from the body portion, the insert member is folded along the fold lines to define an enclosure having a substantially cuboid shape and wherein said insert member is substantially planar when positioned within the body portion, wherein when the insert member is folded into the said cuboid shape, the insert member defines the enclosure that receives and holds the body portion folded upon itself in said storage condition.

2. An article of footwear according to claim 1, wherein said body portion comprises a single piece formed a polymer based material.

3. An article of footwear according to claim 2, wherein said body portion is elastomeric.

4. An article of footwear according to claim 1, wherein said body portion is shaped to extend over both an upper and a lower side of a wearer's foot such that the wearer's foot is at least partially enclosed therein, wherein said body portion is substantially homogenous throughout.

5. An article of footwear according claim 1, wherein said body portion has a first thickness and comprises one or more tread portions formed on the sole having a thickness greater than said first thickness.

6. An article of footwear according to claim 5, wherein said tread portions are integrally formed with said body portion as a single piece.

7. An article of footwear according to claim 1, wherein the puncture resistance of said insert member is greater than that of said body portion.

8. An article of footwear according to claim 1, wherein a pair of said body portions are received within the enclosure formed by said insert member in the storage condition.

9. The article of footwear of claim 8 wherein a pair of the planar inserts each in the storage condition combines to form a complete enclosure that receives the pair of body portions.

10. An article of footwear according to claim 1, wherein said insert member forms at least a portion of a container blank.

11. An article of footwear according to claim 1, wherein said insert member comprises one or more cut or tear lines.

12. An article of footwear according to claim 11, wherein said cut or tear lines define a removable portion, which upon removal defines at lease a peripheral portion of said insert member in use.

13. An article of footwear according to claim 1, wherein said insert member comprises a polymer material.

14. An article of footwear according to claim 1, wherein said insert member comprises a textile material having stab-resistant properties.

15. An article of footwear according to claim 1, wherein said body portion is foldable a plurality of times between the in use and storage conditions such that the plan area of said body portion in the storage condition is less than half the plan area of said body portion in the in use condition.

16. An article of footwear according to claim 15, wherein said plan area of said body portion in the storage condition is one third or less than said plan area of said body portion in the in use condition.

17. An article of footwear according to claim 1, wherein the article of footwear can be accommodated within a volume of 225 $cm^3$ or less.

18. An article of footwear according to claim 1, wherein said body portion has a tread thickness of 3 mm or less.

19. An article of footwear according to claim 1, wherein said body portion has a wall thickness of 2 mm or less.

20. The article of footwear of claim 1, wherein a pair of the planar inserts members each in the storage condition combines to form a complete enclosure that receives a pair of body portions.

* * * * *